US006098831A

United States Patent [19]

Dibble

[11] Patent Number: 6,098,831

[45] Date of Patent: Aug. 8, 2000

[54] PLATE

[76] Inventor: Jerry Dibble, 1341 Mc Kinley St., Anoka, Minn. 55303

[21] Appl. No.: 09/133,468

[22] Filed: Aug. 13, 1998

[51] Int. Cl.[7] ..... B65D 21/02

[52] U.S. Cl. ..... 220/574; 206/503; 229/915

[58] Field of Search ..... 220/574; 206/505, 206/503; 229/915

[56] References Cited

U.S. PATENT DOCUMENTS

| | | | |
|---|---|---|---|
| 1,866,036 | 7/1932 | Hartman et al. | 220/574 |
| 2,170,040 | 8/1939 | Stuart | 220/574 |
| 3,580,484 | 5/1971 | Schneider | 220/574 |
| 3,938,727 | 2/1976 | Andersson | 220/574 |
| 4,609,140 | 9/1986 | Van Handel et al. | 220/574 |
| 5,230,939 | 7/1993 | Baum | 220/574 |
| 5,292,028 | 3/1994 | Patterson et al. | 220/574 |
| 5,549,241 | 8/1996 | Correll | 229/915 |

*Primary Examiner*—Joseph M. Moy

[57] ABSTRACT

A plate for permitting the attachment of an inverted plate on the top of another bottom plate for protectively carrying items such as food stuffs between. The plate includes a plate having top and bottom faces, a base and a lip extending around the base of the plate. The lip has a plurality of separation lines therethrough between the top and bottom faces of the plate. Each separation line of the lip forms a tab and defines a corresponding hole through the plate. Each of the tabs of the lip is outwardly deflectable from both the top and bottom faces of the plate.

13 Claims, 2 Drawing Sheets

10
14
17
18
11
13
17
18
12

21
11
24
22
28
23
27
25
15
12
13
26

PLATE

BACKGROUND OF THE INVENTION

1. Field of the Invention

The present invention relates to plates and food containers and more particularly pertains to a new plate for permitting the attachment of an inverted plate on the top of another bottom plate for protectively carrying items such as food stuffs between.

2. Description of the Prior Art

The use of plates and food containers is known in the prior art. More specifically, plates and food containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,675,811; U.S. Pat. No. 1,945,013; U.S. Pat. No. 3,190,486; U.S. Pat. No. 5,176,282; U.S. Pat. No. Des. 341,518; and U.S. Pat. No. Des. 374,153.

While these devices fulfill their respective, particular objectives and requirements, the aforementioned patents do not disclose a new plate. The inventive device includes a plate having top and bottom faces, a base and a lip extending around the base of the plate. The lip has a plurality of separation lines therethrough between the top and bottom faces of the plate. Each separation line of the lip forms a tab and defines a corresponding hole through the plate. Each of the tabs of the lip is outwardly deflectable from both the top and bottom faces of the plate.

In these respects, the plate according to the present invention substantially departs from the conventional concepts and designs of the prior art, and in so doing provides an apparatus primarily developed for the purpose of permitting the attachment of an inverted plate on the top of another bottom plate for protectively carrying items such as food stuffs between.

SUMMARY OF THE INVENTION

In view of the foregoing disadvantages inherent in the known types of plates and food containers now present in the prior art, the present invention provides a new plate construction wherein the same can be utilized for permitting the attachment of an inverted plate on the top of another bottom plate for protectively carrying items such as food stuffs between.

The general purpose of the present invention, which will be described subsequently in greater detail, is to provide a new plate apparatus and method which has many of the advantages of the plates and food containers mentioned heretofore and many novel features that result in a new plate which is not anticipated, rendered obvious, suggested, or even implied by any of the prior art plates and food containers, either alone or in any combination thereof.

To attain this, the present invention generally comprises a plate having top and bottom faces, a base and a lip extending around the base of the plate. The lip has a plurality of separation lines therethrough between the top and bottom faces of the plate. Each separation line of the lip forms a tab and defines a corresponding hole through the plate. Each of the tabs of the lip is outwardly deflectable from both the top and bottom faces of the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plate apparatus and method which has many of the advantages of the plates and food containers mentioned heretofore and many novel features that result in a new plate which is not anticipated, rendered obvious, suggested, or even implied by any of the prior art plates and food containers, either alone or in any combination thereof.

It is another object of the present invention to provide a new plate which may be easily and efficiently manufactured and marketed.

It is a further object of the present invention to provide a new plate which is of a durable and reliable construction.

An even further object of the present invention is to provide a new plate which is susceptible of a low cost of manufacture with regard to both materials and labor, and which accordingly is then susceptible of low prices of sale to the consuming public, thereby making such plate economically available to the buying public.

Still yet another object of the present invention is to provide a new plate which provides in the apparatuses and methods of the prior art some of the advantages thereof, while simultaneously overcoming some of the disadvantages normally associated therewith.

Still another object of the present invention is to provide a new plate for permitting the attachment of an inverted plate on the top of another bottom plate for protectively carrying items such as food stuffs between.

Yet another object of the present invention is to provide a new plate which includes a plate having top and bottom faces, a base and a lip extending around the base of the plate. The lip has a plurality of separation lines therethrough between the top and bottom faces of the plate. Each separation line of the lip forms a tab and defines a corresponding hole through the plate. Each of the tabs of the lip is outwardly deflectable from both the top and bottom faces of the plate.

Still yet another object of the present invention is to provide a new plate that is stackable with others.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
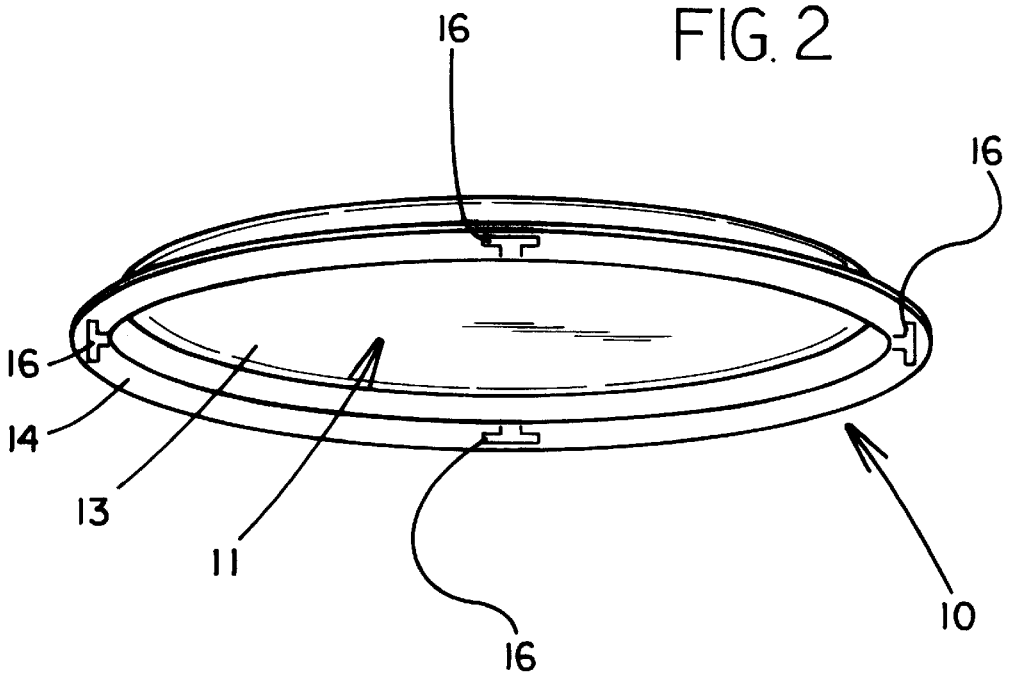
FIG. 2 is a schematic top perspective view of the present invention.

With reference now to the drawings, and in particular to FIGS. 1 through 4 thereof, a new plate embodying the principles and concepts of the present invention and generally designated by the reference numeral 10 will be described.

As best illustrated in FIGS. 1 through 4, the plate 10 generally comprises a plate 10 having top and bottom faces 11, 12, a base 13 and a lip 14 extending around the base 13 of the plate 10. The lip 14 has a plurality of separation lines 16 therethrough between the top and bottom faces 11, 12 of the plate 10. Each separation line 16 of the lip 14 forms a tab 17 and defines a corresponding hole 18 through the plate 10. Each of the tabs 17 of the lip 14 is outwardly deflectable from both the top and bottom faces 11, 12 of the plate 10.

In closer detail, each plate 10 has top and bottom faces 11, 12, a base 13, and a lip 14 upwardly extending around the perimeter of the base 13 of the plate 10. Optionally, the base 13 of the plate 10 also may include an annular resting ridge 15 extending from the bottom face 12 of the plate 10. Preferably, the plate 10 is generally circular such that the base 13 and lip 14 of the plate 10 have generally circular configurations. Optionally, the plate 10 may also be rectangular such that the base 13 and lip 14 of the plate 10 have generally rectangular configurations.

The lip 14 has a plurality of separation lines 16 therethrough between the top and bottom faces 11, 12 of the plate 10. Preferably, there are at least three separation lines 16. Ideally, the lip has four separation lines 16. The separation lines 16 are spaced apart from each other around the lip 14 of the plate 10 and preferably, the separation lines 16 are spaced apart around the lip 14 of the plate 10 at generally equal intervals. The lip 14 is separable along each separation line 16 such that each separation line 16 of the lip 14 forms a tab 17 and defines a hole 18 through the plate 10 corresponding to the outline of the tab 17. Even more preferably, the lip 14 of the plate 10 has perforations or apertures therethrough between the top and bottom faces 11, 12 of the plate 10 along each of the separation lines 16 of the lip 14 of the plate 10 for aiding separation of the lip 14 along each of the separation line 16.

Ideally, each of the tabs 17 is generally T-shaped and each of the holes 18 through the lip 14 has a generally T-shaped periphery corresponding to the associated tab 17. In use, each of the tabs 17 of the lip 14 is deflectable in both an upwards direction from the lip 14 (in other words, from the top of the plate 10) and a downwards direction from the lip 14 (in other words, from the bottom of the plate 10).

Each plate is configured such that, in use, the top face of each plate is designed for resting the bottom face of another plate. In such that the plates of the plurality of plates are stackable one upon another. In particular, each plate is designed for stacking with other plates such that the bottom face of a plate may be stacked on the top face of another the plate 10, and the bottom face of a third the plate may be stacked on the top face 11 of the plate.

Figure 1:
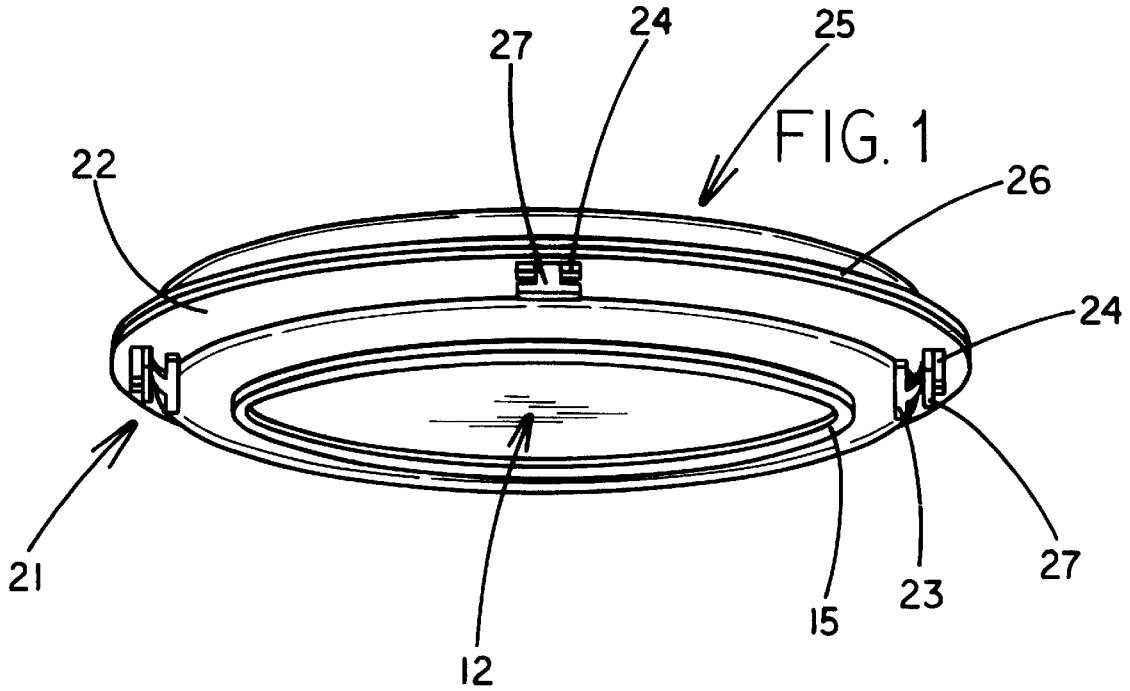
FIG. 1 is a schematic bottom perspective view of an inverted top plate covering the top face of a bottom plate according to the present invention.
Figure 3:
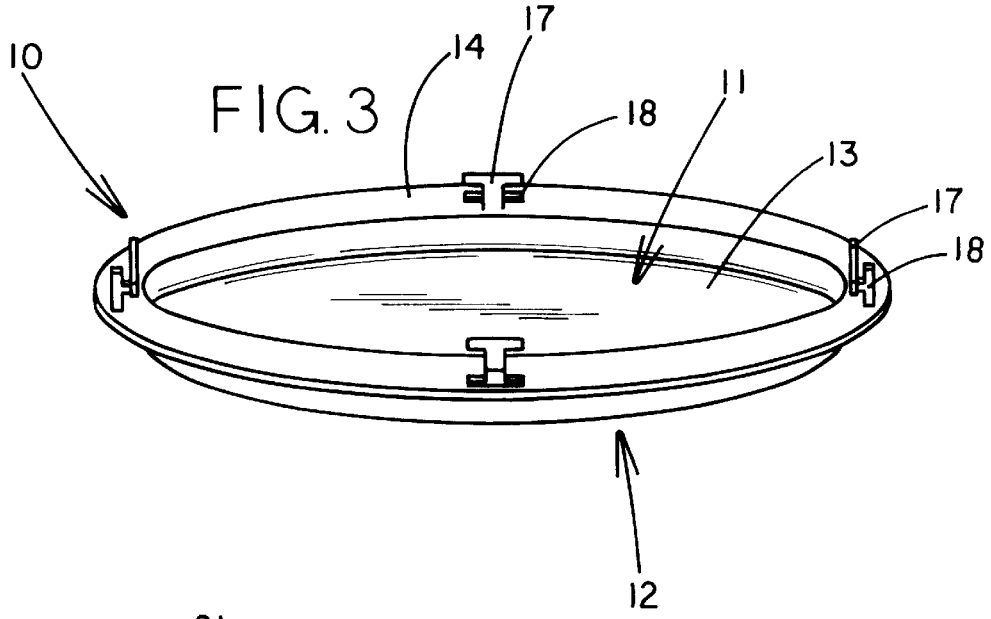
FIG. 3 is a schematic top perspective view of the present invention with the tabs deflected upwards.
Figure 4:
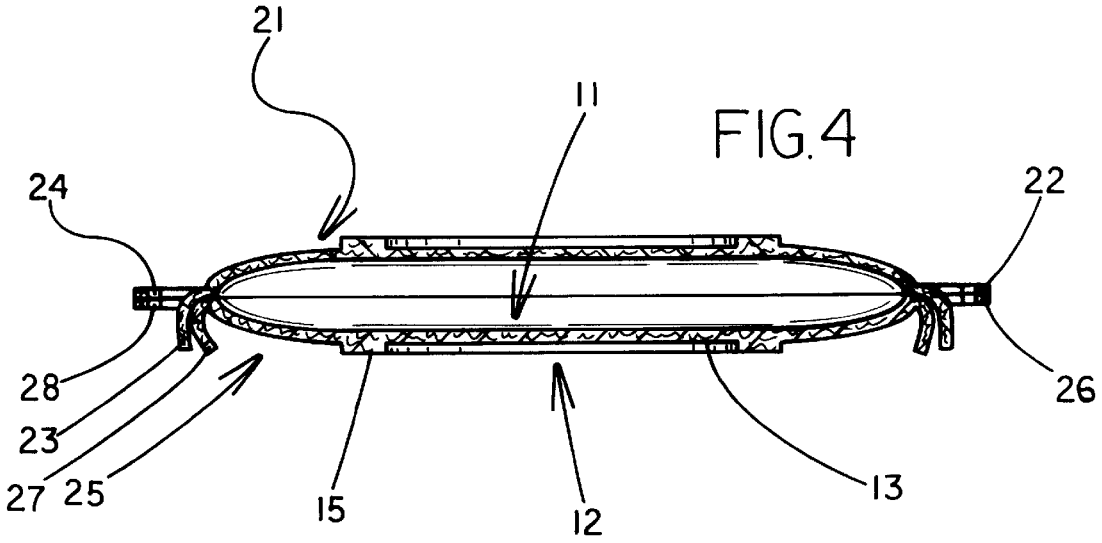
FIG. 4 is a schematic cross-sectional view of the inverted top plate covering the top face of the bottom plate of FIG. 1.

With reference to FIGS. 1 and 4, in use, the top face of the lip 26 of a second plate 25 is restable on the top face of the lip 22 of a first plate 21 such that the second plate 25 substantially covers the top face of the first plate 21. Each tab 27 of the second plate 25 is downwardly deflectable to be inserted into an associated hole 24 of the first plate 21 to attach the second plate 25 to the first plate 21. The tabs 23 of the first plate 21 are deflected downwards when the tabs 27 of the second plate 25 are inserted into their associated holes 24 of the first plate 21. Conversely, each tab 23 of the first plate 21 are upwardly deflectable to be inserted into an associated hole 28 of the second plate 25 to provide another method for attaching the second plate to the first plate.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An stackable article, comprising:

a plate having top and bottom faces, a base and a lip extending around said base of said plate;

said lip having a plurality of separation lines therethrough between said top and bottom faces of said plate;

each separation line of said lip forming a tab and defining a hole through said plate; and each of said tabs of said lip being outwardly deflectable from both said top and bottom faces of said plate.

2. The stackable article of claim 1, wherein said plate is adapted for stacking with other said plates such that said bottom face of said plate may be stacked on the top face of another said plate, and the bottom face of a third said plate may be stacked on said top face of said plate.

3. The stackable article of claim 1, wherein said lip of said plate being adapted for resting thereon the lip of an inverted other said plate to substantially cover said top face of said plate, said holes of said lip of said plate being adapted for receiving therethrough the tabs of said inverted other said plate inserted into each hole of said plate to attach said inverted other said plate to said plate.

4. The stackable article of claim 1, wherein said plate is generally circular such that said base and lip of said plate have generally circular configurations.

5. The stackable article of claim 1, wherein said plate is rectangular such that said base and lip of said plate have generally rectangular configurations.

6. The stackable article of claim 1, wherein said plurality of separation lines comprises three separation lines.

7. The stackable article of claim 1, wherein said plurality of separation lines comprises four separation lines.

8. The stackable article of claim 1, wherein said separation lines are spaced apart from each other around said lip of said plate.

9. The stackable article of claim 8, wherein said separation lines are spaced apart around said lip of said plate at generally equal intervals.

10. The stackable article of claim 1, wherein said lip of said plate has apertures therethrough between said top and bottom faces of said plate along each of said separation lines of said lip of said plate.

11. The stackable article of claim 1, wherein said lip of said lip of said plate has perforations along each of said separation lines.

12. The stackable article of claim 1, wherein each of said tabs is generally T-shaped and each of said holes through said lip having a generally T-shaped periphery.

13. In combination:

a set of at least two stackable plates;

wherein each plate comprises:

top and bottom faces, a base and a lip extending around said base of said plate;

wherein said plate is generally circular such that said base and lip of said plate have generally circular configurations;

said lip having a plurality of separation lines therethrough between said top and bottom faces of said plate, wherein said plurality of separation lines comprises four separation lines;

said separation lines being spaced apart around said lip of said plate at generally equal intervals;

said lip of said lip of said plate having perforations along each of said separation lines;

each separation line of said lip forming a generally T-shaped tab and defining a corresponding generally T-shaped hole through said plate; and each of said tabs of said lip being deflectable both in an upwards direction from said lip and in a downwards direction from said lip;

each plate of said plurality of plates being configured such that said top face of each plate of said plurality of plates is adapted for resting the bottom face of another plate of said plurality of plates such that said plates of said plurality of plates are stackable one upon another; and the top face of the lip of a second plate of said set of plates being restable on the top face of the lip of a first plate of said set of plates such that said second plate substantially covers said top face of said plate, each tab of the lip of said second plate being insertable into an associated hole of the lip of said first plate to attach said second plate to said first plate.

* * * * *